US005921064A

United States Patent [19]

O'Connor

[11] Patent Number: 5,921,064

[45] Date of Patent: Jul. 13, 1999

[54] PACKAGING A STRIP OF MATERIAL

[75] Inventor: Lawrence J. O'Connor, Winnipeg, Canada

[73] Assignees: KT Holdings, Inc., Winnipeg, Canada; Stac-Pac Technologies, Inc., Christchurch, Barbados

[21] Appl. No.: 08/876,402

[22] Filed: Jun. 16, 1997

[51] Int. Cl.[6] ..... B65B 63/04; B65B 31/00; B65B 61/06

[52] U.S. Cl. ..... 53/429; 53/434; 53/435; 493/415; 493/357; 493/363; 206/494; 206/524.8

[58] Field of Search ..... 53/429, 116, 117, 53/434, 435, 513, 520, 157; 493/410, 411, 413, 414, 415, 437, 448, 439, 440, 357, 356, 363; 206/494, 524.8

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 3,245,680 | 4/1966 | Harrison et al. | 493/413 |
| 3,351,992 | 11/1967 | Carter | 53/429 |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,941,374 | 7/1990 | Focke | 53/157 X |
| 5,036,977 | 8/1991 | Schofield et al. . | |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

FOREIGN PATENT DOCUMENTS

| | | | |
|---|---|---|---|
| B-22983/83 | 3/1986 | Australia . | |
| 383501 | 8/1990 | European Pat. Off. . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson
*Attorney, Agent, or Firm*—Oliff & Berridge, PLC; Adrian Battison

[57] ABSTRACT

A package of a continuous strip of material includes a plurality of parallel side by side stacks each containing a length of the strip which is folded back and forth such that each folded portion of the stack is folded relative to the next portion about a line transverse to the strip and such that the side edges of the strip portions are aligned. The stacks are formed in a stepped fashion, with a series of separate layers being laid down for each stack. The package can be compressed to reduce the height of the stacks and maintained in the compressed condition by an evacuated sealed bag.

15 Claims, 3 Drawing Sheets

FIG. 2
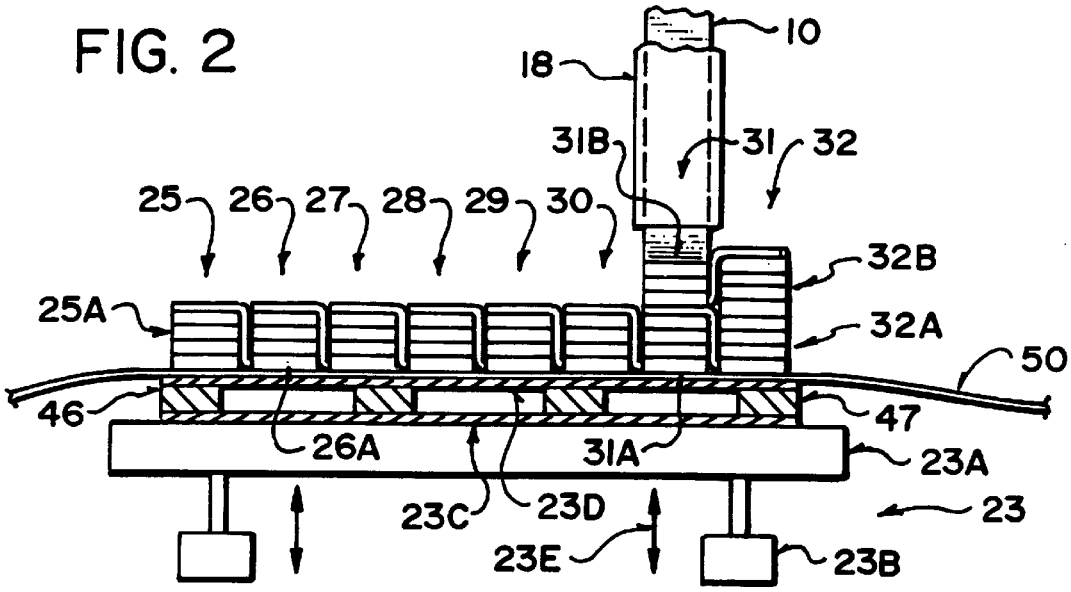
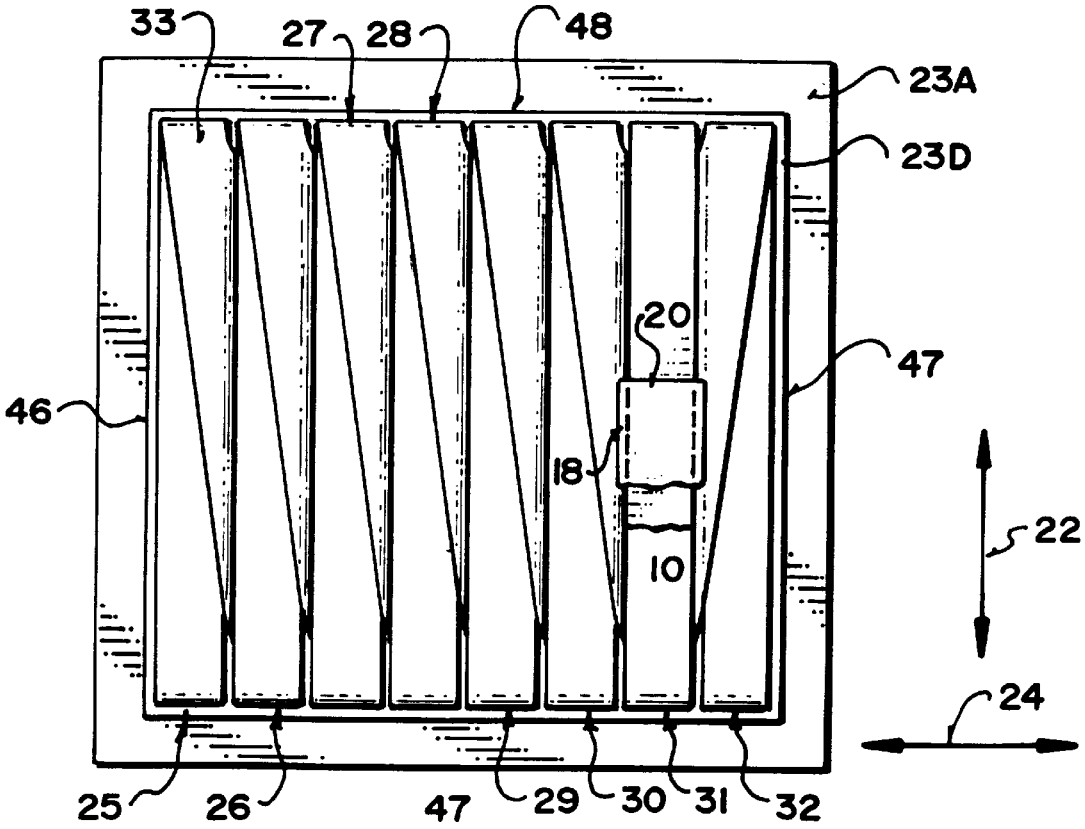
FIG. 3

PACKAGING A STRIP OF MATERIAL

This invention relates to a method for packaging a strip of material using a technique known as "festooning" in which the strip is conventionally guided into a receptacle such as a cardboard box while a first reciprocating movement causes lengths of the strip to be laid across the receptacle and a second reciprocating movement causes the positions of the lengths to be traversed relative to the receptacle transversely to the lengths.

BACKGROUND OF THE INVENTION

The technique of festooning has been available for many years and is used in packaging many different types of material but particularly material of a fibrous nature such as fabric, non-woven strips and the like. Normally the receptacle comprises a rigid rectangular container at least partly of cardboard having a base and four upstanding sides.

The purpose of the festooning method is for packaging the strip for transportation from a converter or manufacturer of the strip to a user of the strip. Some users prefer the festooned package relative to a wound package of this type of material since both the leading end and the tail end of the package are available at the top of the package so that a series of the packages can be connected lead to tail to act as an extended supply. In addition since the material is simply laid into the package, there is less problem with tension control in the material as it is withdrawn from the package, in comparison with wound packages where tension control of large packages can be a problem due to the inertia of the package thus requiring a driven unwind stand as well as material handling equipment for moving the large rolls. There is therefore no need when festooned packages are used for a complex unwind stand which takes up more space than may be available and involves significant cost for the unwind stand and for the services to power the unwind stand.

Festooned packages are formed in a stiff container or box to properly enclose and contain the material and within which the material is stored during transportation for maintaining the material against compression and distortion due to the transfer of loads from surrounding packages. The cardboard container thus provides support for other similar containers in stacked condition and prevents the transfer of loads from the stacked packages from causing compression of packages at the bottom of a stack. The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

SUMMARY OF THE INVENTION

It is one object of the present invention, therefore, to provide an improved method of packaging a strip of material for transportation in which the stability of the package can be improved and in which the transportation of returned containers can be avoided.

According to one aspect of the invention there is provided a method of packaging a strip of material comprising:

- forwarding a strip of material from a supply thereof in a direction longitudinal of the strip;
- providing a generally horizontal support surface onto which the strip is laid for receiving and packaging the strip;
- providing a discharge guide member engaging and guiding the strip for discharge onto the support surface;
- causing a first relative reciprocating movement between the guide member and the support surface in a first direction across the support surface so as to repeatedly lay lengths of the strip across the support surface from a first edge of the support surface to a second opposed edge of the support surface and back from the second edge to the first edge;
- causing a second relative reciprocating movement between the guide member and the support surface in a second direction generally transverse to the first direction such that the laid lengths of the strip traverse back and forth across the support surface from a third edge of the base to a fourth opposed edge of the support surface;
- thereby building a festooned package of the strip on the support surface;
- wherein the second relative movement is arranged so as to be intermittent including a series of stationary positions so as to define a plurality of separate positions of the strip between the third and fourth edges, at which positions a plurality of lengths of the strip are laid directly each on top of an underlying length to form a step of stacked lengths and in between the positions the strip is traversed by said second relative movement from one position to a next adjacent position.

Preferably the positions are arranged substantially side by side such that the edges of the step of stacked lengths at one position lie substantially in contact with the edges of the step of stacked lengths at the next adjacent position.

Preferably the method includes wrapping the festooned package in a flexible packaging material such that the flexible packaging material applies pressure to the festooned package.

Preferably the method includes providing a packaging enclosure enclosing the festooned package formed from the flexible packaging material; causing compression of the festooned package and extraction of air therefrom such that a top surface thereof moves downwardly toward the support surface and closing the packaging enclosure within which the festooned package is in a compressed condition for transportation. Preferably the packaging enclosure is sealed to maintain a vacuum.

Preferably the compression of the festooned package is effected by sealing the packaging enclosure, physically compressing the top of the package and extracting air from the packaging enclosure.

Preferably the festooned package is free from confining side walls at end steps of the package as it is being formed.

Preferably the support surface comprises a pallet and the festooned package is wrapped onto the pallet by a flexible wrapping material.

Preferably the package is maintained stationary during formation and the first and second relative movements are effected by movement of the guide member.

Preferably the method includes providing at least one generally horizontal support member in the package on top of a plurality of steps at each end step of the package so as to form a horizontal support surface for further steps on each end step.

One embodiment of the invention will now be described in conjunction with the accompanying drawings in which:

BRIEF DESCRIPTION OF THE DRAWINGS

FIG. 2 is a cross sectional view along the lines 2—2 of FIG. 1.

FIG. 3 is a top plan view of the container of FIG. 1.

In the drawings like characters of reference indicate corresponding parts in the different figures.

DETAILED DESCRIPTION

Figure 1:
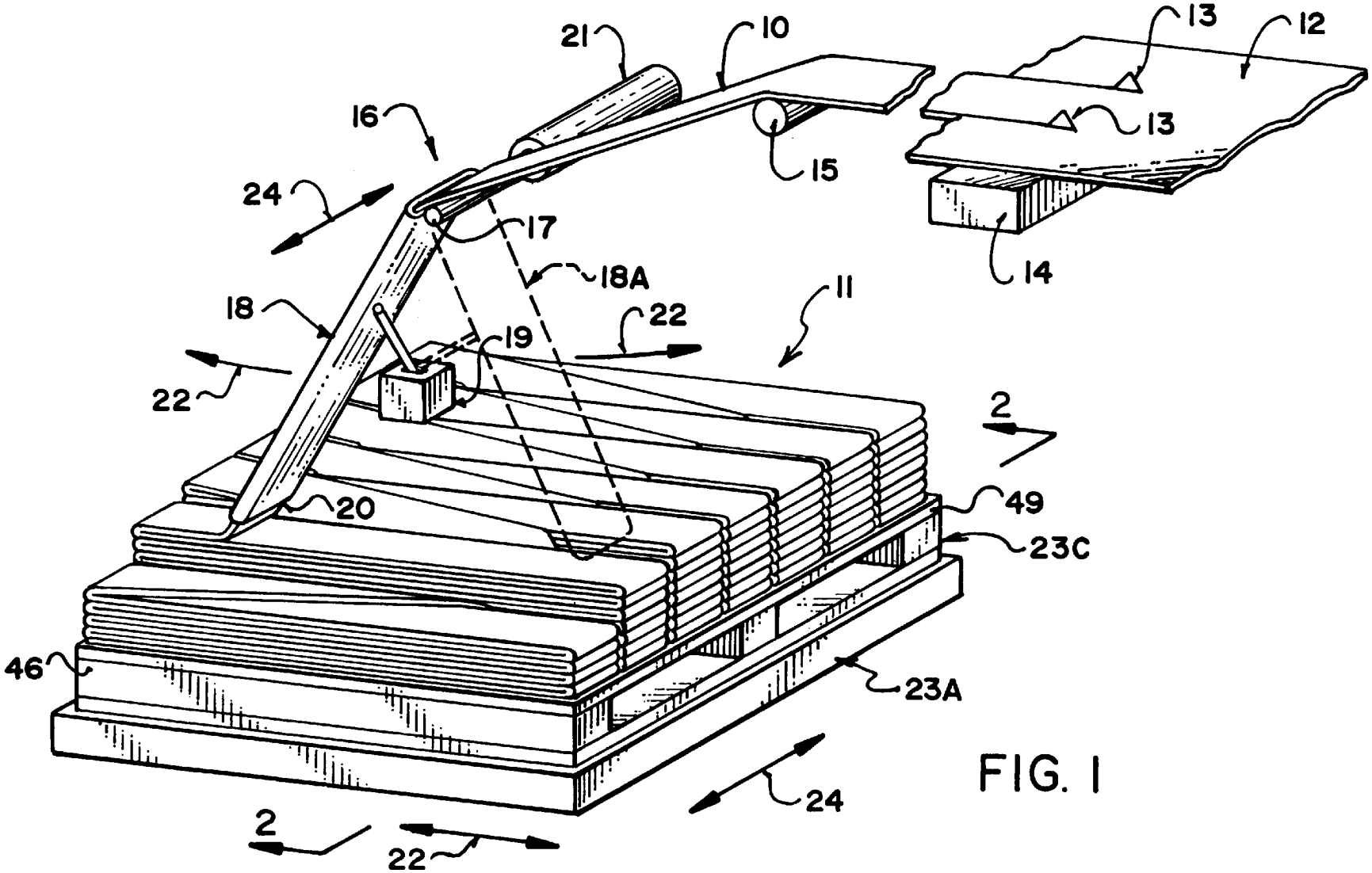
FIG. 1 is a schematic isometric view of a packaging method according to the present invention.

A strip of a material is indicated at 10 for packaging in a festooning system generally indicated at 11. The strip 10 is slit from a web 12 of the material using slitter knives 13 carried on a slitter bar 14. The supply system is shown only schematically since it is well known to one skilled in the art and only one festoon packaging system is indicated although of course the strips slit from the web would all be wound in similar packaging systems (not shown).

The strip 10 is forwarded on a feed roller 15 to a guide system 16 having a fixed point 17 over which the strip passes. A guide member 18 is pivotally mounted at the fixed point 17 and actuated to pivot back and forth by an actuating mechanism generally indicated at 19 and shown only schematically since this again is well known to one skilled in the art. Two positions of the guide mechanism 18 are indicated in full line and in dotted line at 18A, The pivotal movement takes place about an axis which lies transverse to the strip so that the tension in the strip is not altered by the back and forth movement of the guide mechanism 16.

The structure of the guide mechanism 16 can be selected in accordance with requirements and can be a tubular member through which the strip passes having dimensions so as to receive the strip in sliding movement through the tubular member. Alternatively the guide mechanism may include a support plate and guide rollers at the lower end of the plate which rotate to feed the strip forwardly at a rate similar to the feed rate from the roller 15 and to lay the strip onto the package.

The guide mechanism 18 thus defines a discharge member 20 which confines and guides the strip so that it follows the movement of the guide member 18.

Thus the discharge member 20 moves in a first reciprocating action in a direction 22 longitudinal to the strip between extreme positions. This reciprocating movement 22 causes the strip to be laid in lengths folded back and forth on top of one another with the ends of the lengths defined by the extreme positions. The strip is compressed at the ends of the stroke by a tamper or other device such as a roller which forms a crease in the strip.

The packaging system further includes a second traversing system generally indicated at 21 which causes movement in a direction of the arrow 24 in a direction generally at right angles to the first movement 22.

The movement 24 thus causes the lengths to traverse so that instead of being laid directly on top of one another, there is an additional movement at right angles to the lengths.

The packaging system further includes a horizontal support 23 defined by a vertically movable pad 23A carried on actuators 23B and carrying a pallet 23C. The actuators move an upper horizontal support surface 23D of the pallet vertically downwardly as indicated at 23E as the package is built so that the discharge member sweeps across the top surface of the package as close as possible to the package at all times through the build of the package.

As shown in FIGS. 2 and 3, the movement 24 effected by the actuator 21 is intermittent so as to form a series of stationary positions 25, 26, 27, 28, 29, 30, 31 and 32. At these positions the traversing movement 24 is held stationary for a period of time during which the lengths are laid directly each on top of the previous layer to form a stack of the lengths. Thus a first stack of the lengths indicated at 25A is formed at the position 25. Similarly further stacks 26A through 32A are formed at the positions 26 through 32. When each stack is completed, the movement 24 is restarted by the actuator 21 so as to traverse the strip in a diagonal direction as indicated at 33 so that the strip moves from the top of the stack 25A to the bottom of the stack 26A. When the traverse is moved to the position 26, the stack 26A is formed on top of the traversed portion of the strip.

This process is repeated to form the stacks 26A through 32A following which the traverse movement is reversed so as to form stacks 32B and 32C. As shown in FIGS. 2 and 3, the traverse movement 24 has been reversed after formation of the stack 32A to form the stack 32B which is positioned directly on top of the stack 32A. After this movement is complete, a further traverse movement 34 is effected moving the strip on top of the stack 31A so as to form the partially formed stack 318 as shown.

As indicated, the stacks of the lengths are arranged substantially immediately adjacent one another with only sufficient spacing to allow the traverse to occur and to continue to lay down the lengths in an orderly manner. In each stack the lengths lie directly each on top of the next so that the edges are aligned. In this way the edges of one stack lie substantially immediately adjacent or in contact with the edges of the next adjacent stack.

The process is continued through a further series of stacks up to a top row of stacks indicated at 25X through 32X. At this point, the package is completed to a predetermined required height and the formation of the package is terminated. The completed package can then be removed from the packaging system and packaging further carried out on a next package with the process being repeated.

Therefore, the package is formed from the series of stacked positions 25 through 32 with the stacks at those positions being in immediately adjacent or contacting relationship with the interconnecting traversed portions throughout the stacks as will be apparent from the previously described process.

The package is formed on the horizontal support surface without any support container. Thus the edges 46 and 47 of the base or support surface 23D lie parallel to the first movement 22. The edges 48 and 49 of the base lie parallel to the movement 24. Thus the package formed is rectangular with vertical sides.

The pallet 23C carries a packaging container 50 of a flexible plastics packaging material which is shaped with a base and upstanding sides 52 which can be folded at right angles to the base. The container is formed from a flexible heat sealable plastics material with upper edges 53 which can be pulled upwardly to a position exposed beyond the top of the container 40.

The plastics container 50 is then closed by folding in the exposed edges 53 and the edges 53 are engaged into a vacuum extraction system generally indicated at 60 which includes a heat sealing member and a vacuum duct so as to extract air from the packaged material and to draw the top 53 downwardly onto the top of the package material thus acting to compress the packaged material. A physical compression of the top of the package can also be effected to assist the extraction of air.

Some materials can be compressed to the maximum extent physically possible to minimize transportation and storage dimensions.

Other materials, particularly those of a fibrous nature having a predetermined loft or height in an initial rest position, have a predetermined requirement for loft or height for processing in the next operation. In this case, the amount of compression is effected to a predetermined amount which is determined so that the material when withdrawn from the package achieves the pre required loft or height of the material for further processing. It will be appreciated that excessive compression of the material for an extended period of time after packaging can compress the fibrous material to a degree which is unacceptable for the further processing. Therefore the amount of compression is carefully predetermined so that it allows the material to produce the pre-required height or loft.

The vacuum packaging system 60, after compression by vacuum extraction and possibly mechanical compression to the required height completes a seal of the plastics material thus fully enclosing and sealing the packaged strip within the container 50. In this condition the packaged container 50 with the material contained and compressed therein can be withdrawn from the support pad 23A for transportation. Normally the pallet 23C is attached to the package for transportation and this can be effected by attaching the plastics bag 50 to the pallet before forming the package or by shrink wrapping the package and pallet with a wrapping 65 after the package is complete and the container 50 sealed.

Figure 5:
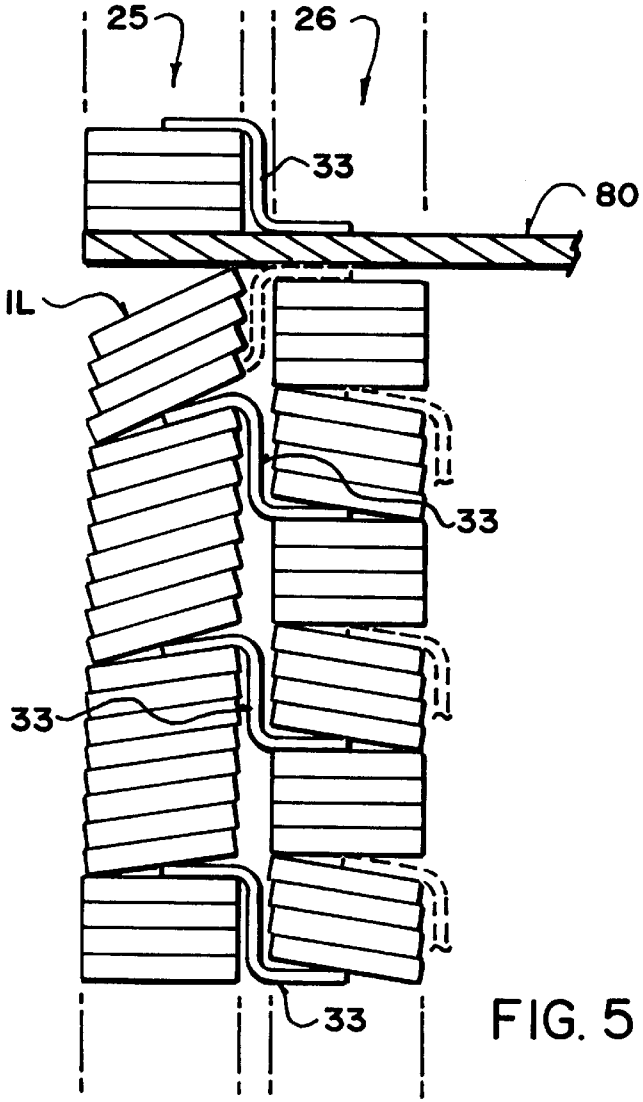
FIG. 5 is an enlarged schematic cross-section through one portion of the package structure.
Figure 4:
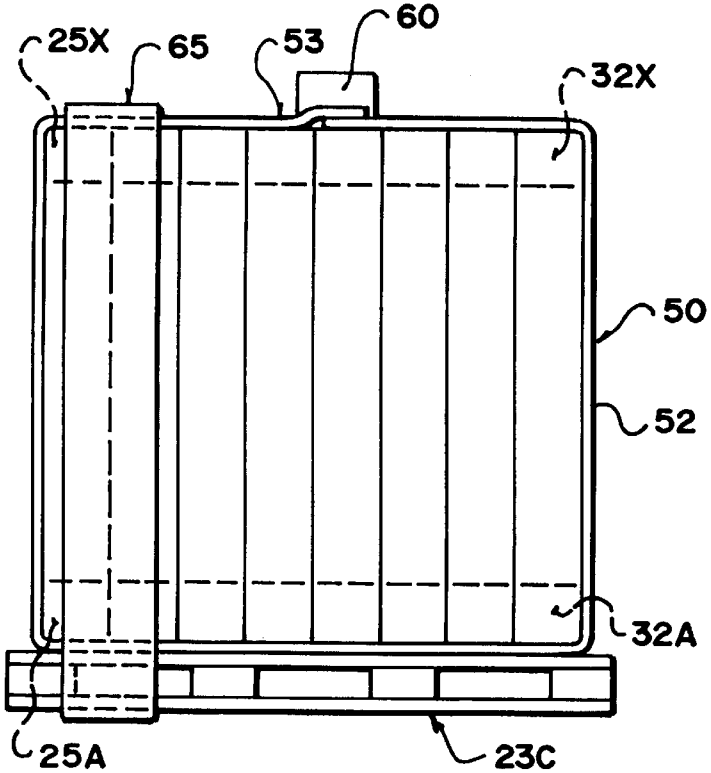
FIG. 4 is a cross sectional view similar to that of FIG. 2 showing the package material after the package is complete.

In FIG. 5 there is shown a cross-section of a part only of the package. The number of layers in each step portion can be a minimum of one layer in each intermediate step 26 to 31 and a minimum of two layers in each end step 25 and 32. The maximum number of layers depends upon the width and thickness of the material in that the step portion cannot be so high that the traverse portion joining each step to the next cannot pass between the steps without distortion or twisting. In most cases each intermediate step portion will include a number of layers of the order of 2 to 10 and each end step will include approximately twice that number. The length of the strip which is included in each traverse portion will normally be one length of the material from one edge to the opposite edge, but a reduced traverse speed can be used to take more than one length to effect traverse if the material will accommodate this. The traverse thus starts as the strip is reversed at one edge and ends at the other edge of the package. It will be noted that the side of the package at the left side of the step 25 and similarly at the right edge of step 32 is completely unsupported by a side support element such as a box side. In addition, the ends of the steps are unsupported. In this way the wand or guide 18 is unencumbered by side walls and is free to move in any direction above the top surface of the package as it is being formed. Other movements than the pendulum motion of the wand as shown can therefore be used for more accurate control of the laydown of the strip, including the use of guide rollers for acting as lay-on rollers contacting the top of the step being formed.

It will also be noted that the edges at the steps 25 and 32 have a tendency to form inclined layers, as indicated at IL in FIG. 5, due to the traverse portions 33 entering and leaving those steps from only one side. If this becomes excessive during formation of a package, a stiff leveling plate can be placed in the package structure as indicated at 80 to define a further horizontal surface for restarting the layers in a horizontal orientation. The plate 80 can have a filler element which is triangular to fill the inclined space so as to reduce the rigidity required.

In another arrangement not shown, the steps can be formed only at the end positions 25 and 32 and the strip traversed in conventional manner across the area therebetween.

The arrangement described above, therefore, provides a technique for enhanced transportation of a festooned package in that the package is contained within a heat sealed plastics material which does not need to be recycled. Furthermore the package is of reduced dimensions so that its density is increased for improved efficiency and transportation. Yet further the package remains in a predetermined condition and dimensions to avoid distortion or further compression of the material while avoiding the use of stiff support containers which must be recycled and using only inexpensive wrapping material and pallets which can be discarded or the pallets re-used.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of making a package of a strip of material comprising:

forwarding a strip of material from a supply thereof in a direction longitudinal of the strip;

providing a generally horizontal support surface onto which the strip is laid for receiving and packaging the strip;

providing a discharge guide member engaging and guiding the strip for discharge onto the support surface;

causing a first relative reciprocating movement between the guide member and the support surface in a first direction across the support surface so as to repeatedly lay lengths of the strip across the support surface from a first edge of a base of the package on the support surface to a second opposed edge of the base of the package on the support surface and back from the second edge to the first edge;

causing a second relative intermittent reciprocating movement between the guide member and the support surface in a second direction generally transverse to the first direction such that the laid lengths of the strip progressively traverse back and forth across the support surface from a third edge of the base of the package on the support surface to a fourth opposed edge of the base of the package on the support surface thereby building a package of the strip on the support surface;

wherein the second relative intermittent reciprocating movement includes a series of stationary positions so as to define a plurality of separate positions of the strip between the third and fourth edges, at which positions a length of the strip is laid directly on top of an underlying length to form a stack of the strip and in between the positions the strip is traversed by said second relative movement from a stack at one position to a next adjacent position.

2. The method according to claim 1 wherein the positions are arranged substantially side by side such that a side edge of the stack at one position lies substantially directly adjacent to a side edge of the stack at the next adjacent position.

3. The method according to claim 1 including wrapping the package in a flexible packaging material such that the flexible packaging material applies pressure to the package at sides and a top of the package.

4. The method according to claim 3 including forming the packaging as an enclosure enclosing the package; causing compression of the package and extraction of air therefrom such that a top surface thereof moves downwardly toward the support surface and closing the packaging enclosure within which the package is in a compressed condition for transportation.

5. The method according to claim 4 wherein the packaging enclosure is sealed and the air is extracted therefrom.

6. The method according to claim 5 wherein the compression of the package is effected by the extraction of the air from the packaging enclosure.

7. The method according to claim 1 wherein the support surface comprises a pallet and the package is wrapped onto the pallet by a flexible wrapping material.

8. The method according to claim 1 including, after forming a plurality of stacks at each end position, providing at least one generally horizontal support member in the package on top of the plurality of stacks at the end positions of the package so as to form a horizontal support surface for further stacks on each end position.

9. A package comprising:

a strip of material having two surfaces and two side edges;

the strip of material being folded back and forth so as to be reciprocated in a first direction so as to define a plurality of lengths of the strip laid across the package from a first edge of the package to a second opposed edge of package on the support surface and back from the second edge to the first edge, the laid strip lengths being arranged such that each has the surfaces thereof parallel to a base of the package;

the laid strip lengths being arranged to define a plurality of positions across the package side by side along a second direction generally at right angles to the first direction;

at each position the strip including a plurality of lengths of the strip which are laid in a stack so as to be directly on top of each other to form a stack with the side edges aligned thus defining for each stack a height of the stack from the base of the package to a top of the stack;

the strip including for each position a plurality of traverse portions traversing from one stack to the next stack, the traverse portions being spaced each from the next through the height of the stack.

10. The package according to claim 9 wherein the positions are arranged substantially side by side such that a side edge of the stack at one position lie substantially in contact with a side edge of the stack at the next adjacent position.

11. The package according to claim 9 wherein the package is wrapped in a flexible packaging material such that the flexible packaging material applies pressure to the package at sides and a top of the package.

12. The package according to claim 11 wherein the package is compressed and the packaging material encloses the compressed package.

13. The package according to claim 12 wherein the packaging material is sealed.

14. The package according to claim 9 wherein there is provided a pallet and the package is wrapped onto the pallet by a flexible wrapping material.

15. The package according to claim 9 including at least one generally horizontal support member in the package located in the stack at each end position of the package so as to form a horizontal support surface for further laid strip lengths of the stack on top of the horizontal support.

* * * * *

UNITED STATES PATENT AND TRADEMARK OFFICE

CERTIFICATE OF CORRECTION

PATENT NO. : 5,921,064
DATED : July 13, 1999
INVENTOR(S) : Lawrence J. O'CONNOR

It is certified that error appears in the above-identified patent and that said Letters Patent is hereby corrected as shown below:

On the face of the patent, at [73], Title "KT Holdings, Inc., Winnipeg, Canada;".

Signed and Sealed this

Seventh Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,921,064
DATED : July 13, 1999
INVENTOR(S) : Lawrence J. O'CONNOR

It is certified that error appears in the above-identified patent and that said Letters Patent is hereby corrected as shown below:

On the title page item [73], delete "KT Holdings, Inc., Winnipeg, Canada;".

This certificate supersedes Certificate of Correction issued December 7, 1999.

Signed and Sealed this

Second Day of May, 2000

*Attest:*

Q. TODD DICKINSON

*Attesting Officer*

*Director of Patents and Trademarks*